US005545499A

United States Patent [19]

Balthis et al.

[11] Patent Number: 5,545,499

[45] Date of Patent: Aug. 13, 1996

[54] ELECTROPHOTOGRAPHIC PHOTOCONDUCTOR HAVING IMPROVED CYCLING STABILITY AND OIL RESISTANCE

[75] Inventors: Vernon M. Balthis, Longmont; Ronald A. Merten, Boulder; Robert J. Rumery, Longmont; Robert L. Vollmer, Boulder, all of Colo.

[73] Assignee: Lexmark International, Inc., Greenwich, Conn.

[21] Appl. No.: 499,147

[22] Filed: Jul. 7, 1995

[51] Int. Cl.[6] ..... G03G 5/47

[52] U.S. Cl. ..... 430/59; 430/58; 430/96

[58] Field of Search ..... 430/58, 59, 96

[56] References Cited

U.S. PATENT DOCUMENTS

| | | | |
|---|---|---|---|
| Re. 27,117 | 4/1971 | Byrne et al. | 430/78 |
| 3,357,989 | 12/1967 | Bryne et al. | 430/78 |
| 3,554,794 | 1/1971 | Geisler et al. . | |
| 3,652,269 | 3/1972 | Contois et al. | 430/96 |
| 3,738,833 | 6/1973 | Merrill et al. | 430/96 |
| 3,816,118 | 6/1974 | Byrne | 430/78 |
| 3,868,251 | 2/1975 | Matsumoto et al. | 430/96 |
| 4,026,704 | 5/1977 | Rochlitz et al. | 430/58 |
| 4,030,921 | 6/1977 | Akira et al. | 430/96 |
| 4,218,528 | 8/1980 | Shimada et al. | 430/76 |
| 4,301,224 | 11/1981 | Kozima et al. | 430/58 |
| 4,330,662 | 5/1982 | Bales | 528/176 |
| 4,434,219 | 2/1984 | Sumino | 430/96 |
| 4,456,672 | 6/1984 | Ellingsfeld et al. | 430/59 |
| 4,973,536 | 11/1990 | Horie et al. | 430/59 |
| 4,975,350 | 12/1990 | Fujimaki et al. | 430/59 |
| 5,053,303 | 10/1991 | Sakaguchi et al. | 430/59 |
| 5,075,189 | 12/1991 | Ichino et al. | 430/59 |
| 5,130,215 | 7/1992 | Adley et al. | 430/58 |
| 5,168,022 | 12/1992 | Wasmund et al. | 430/58 |
| 5,194,354 | 3/1993 | Takai et al. | 430/58 |
| 5,204,199 | 4/1993 | Sugiuchi et al. | 430/58 |
| 5,204,200 | 4/1993 | Kobata et al. | 430/58 |
| 5,208,127 | 4/1993 | Terrell et al. | 430/59 |
| 5,364,727 | 11/1974 | Nguyen | 430/119 |

*Primary Examiner*—Roland Martin

*Attorney, Agent, or Firm*—Steven J. Goldstein; John A. Brady

[57] ABSTRACT

A photoconductor for use in electrophotographic reproduction devices is disclosed. This photoconductor exhibits improved oil resistance when used with liquid toners and excellent cycling stability. The photoconductors of the present invention utilize a phthalocyanine dye, particularly an X-form metal-free phthalocyanine, dispersed in a medium molecular weight polyvinyl chloride binder in the charge generating layer, and a charge transport molecule, particularly a hydrazone such as DEH, in a polyestercarbonate binder in the charge transport layer.

12 Claims, No Drawings

ELECTROPHOTOGRAPHIC PHOTOCONDUCTOR HAVING IMPROVED CYCLING STABILITY AND OIL RESISTANCE

TECHNICAL FIELD

The present invention relates to an improved photoconductor, used in electrographic reproduction devices, having a charge generating layer and a charge transport layer, which exhibits excellent cycling stability and oil resistance.

BACKGROUND OF THE INVENTION

The present invention is a layered electrophotographic photoconductor, i.e., a photoconductor having a metal ground plane member on which a charge generation layer and a charge transport layer are coated, in that order. Such a photoconductor may optionally include a barrier layer located between the metal ground plane member and the charge generation layer, and/or an adhesion promoting layer located between the barrier layer and the charge generation layer, and/or an overcoat layer on the top surface of the charge transport layer. In photoconductors of this type, the charge generation function and the charge transport function are provided by different discrete layers that are coated at different times during the manufacture of the photoconductor.

In electrophotography, a latent image is created on the surface of an insulating, photoconducting material by selectively exposing areas of the surface to light. A difference in electrostatic charge density is created between areas on the surface exposed and unexposed to the light. The latent electrostatic image is developed into a visible image by electrostatic toners containing pigment components and thermoplastic components. The toners are selectively attracted to the photoconductor surface either exposed or unexposed to light, depending on the relative electrostatic charges on the photoconductor surface, development electrode and the toner. The photoconductor may be either positively or negatively charged, and the toner system similarly may contain negatively or positively charged particles. For laser printers, in the preferred embodiment the photoconductor and toner have the same polarity but different levels of charge.

A sheet of paper or intermediate transfer medium is given an electrostatic charge opposite that of the toner and then passed close to the photoconductor surface, pulling the toner from the photoconductor surface onto the paper or intermediate medium still in the pattern of the image developed from the photoconductor surface. A set of fuser rollers melts and fixes the toner in the paper, subsequent to direct transfer, or indirect transfer when an intermediate transfer medium is used, producing the printed image.

The electrostatic printing process, therefore, comprises an ongoing series of steps wherein the photoconductor surface is charged and discharged as printing takes place. It is important to keep the charge voltage and discharge voltage on the surface of the photoconductor constant as different pages are printed in order to make sure that the quality of the images produced are uniform (cycling stability). If the charge/discharge voltages change each time the drum is cycled, e.g., if there is fatigue in the photoconductor surface, the quality of the pages printed will not be uniform and will be unsatisfactory.

It is desirable to use liquid toners in the electrophotographic printing process in order to get the highest possible resolution on the printed page. However, on most photoconductive surfaces, the oil carrier present in the liquid toner tends to extract charge transport molecules from the photoconductor drum. This destroys the toner and results in higher discharge voltages on the drum and poor quality in the printed pages produced. This oil extraction, which results from the use of liquid toner, may also disrupt the charge generation layer.

Thus, it is important, when designing a photoconductor, to have one which maximizes both oil resistance when liquid toners are used, and cycling stability.

The present invention, by using specific components in the charge generation and charge transport layers, provides both improved cycling stability and improved oil resistance when compared to conventional photoconductors. The present invention utilizes phthalocyanine dyes, preferably X-form metal-free phthalocyanines, together with a medium molecular weight polyvinyl chloride binder in the charge generation layer, and a polyestercarbonate binder in the charge transport layer to provide these improved results.

X-form metal-free phthalocyanine materials have been disclosed for use as pigments in photoconductors used in electrophotographic reproduction devices. U.S. Pat. No. 5,168,022, Wasmund et al., issued Dec. 1, 1992, describes a process for making X-form phthalocyanine materials. These materials are taught to be useful in the charge generation layer of a photoconductive imaging member together with polymeric binders, such as polyvinylbutyral and polyvinylacetate.

U.S. Pat. No. 3,816,118, Byrne, issued Jun. 11, 1974, describes electrophotographic plates which include a phthalocyanine pigment dispersed in a binder. X-form phthalocyanine is preferred. Binders useful in the disclosed invention include polyvinyl chloride and polycarbonate, as well as many other conventional binder materials.

U.S. Pat. No. Reissue 27,117, Byrne et al., reissued Apr. 20, 1971, discloses X-form phthalocyanine which is taught to be useful as a photoconductive material when mixed with a binder and coated on a substrate.

U.S. Pat. No. 5,364,727, Nguyen, issued Nov. 15, 1994, describes a positive charging photoconductor, for use with a liquid toner, comprising a fine particle phthalocyanine pigment and an amine-type sensitizer distributed in a polymeric binder. X-form phthalocyanines are taught to be preferred pigments, while any conventional polymeric binder, including polycarbonates, are taught as being useful.

U.S. Pat. No. 5,075,189, Ichino, issued Dec. 24, 1991, describes an electrophotographic photoreceptor which comprises an N-alkoxylated or N-alkylated polyamide copolymer undercoat layer together with a charge generating layer which includes a pigment and a conventional binder resin. X-form phthalocyanine is taught to be one of many pigments with which may be used in the disclosed invention, together with conventional binders including vinyl chloride resin and polycarbonate resin.

U.S. Pat. No. 5,204,200, Kobata, et al., issued Apr. 20, 1993, describes a laminated organic photosensitive material which utilizes an alcohol-soluble polyamide resin as an undercoat. In this invention, the charge generating layer contains an X-form phthalocyanine and, as a binder, a mixture of vinyl chloride-ethylene copolymer and vinyl chloride-vinyl acetate-maleic acid copolymer. The binder resin in the charge transport layer may be a polycarbonate material.

U.S. Pat. No. 4,218,528, Shimada, et al., issued Aug. 19, 1980, describes a method for forming an electrostatic image using an activation light to prevent dark decay. In this method, the photoconductor includes a fine photoconductive powder, such as metal-free phthalocyanine among many others, dispersed in a resin which may include polycarbonates, although phenol resins are preferred.

U.S. Pat. No. 4,973,536, Horie, et al., issued Nov. 27, 1990, describes an electrophotographic photoreceptor which includes a phthalocyanine pigment in the charge generating layer and a specifically-defined hydrazone in the charge transport layer. X-form phthalocyanine is specifically disclosed, although not preferred. Useful binders include polycarbonates and polyvinyl chloride, among many others.

U.S. Pat. No. 4,975,350, Fujimaki, et al., issued Dec. 4, 1990, describes a photoreceptor which includes X-form metal-free phthalocyanine in the charge generating layer together with conventional binders, including polycarbonates and polyvinyl chloride. The disclosed photoreceptor also includes specifically-defined carrier transport materials, including hydrazones.

U.S. Pat. No. 5,053,303, Sakaguchi, et al., issued Oct. 1, 1991, describes electrophotographic photosensitive materials which comprise X-form metal-free phthalocyanine and a binder (polyvinyl chloride is not disclosed) in the charge generating layer, and a hydrazone, butadiene or pyrazoline compound together with a polycarbonate binder in the charge transport layer.

Polyvinyl chloride and polycarbonates are also known as binders in photoconductor structures. For example, U.S. Pat. No. 5,130,215, Adley, et al., issued Jul. 14, 1992, describes a layered photoconductor which utilizes a specific ordered polyestercarbonate as a binder in one or both of the charge transport and charge generating layers. A structure having a charge transport layer comprising a hydrazone and a polyestercarbonate binder is specifically disclosed. It is taught that the invention exhibits reduced discharge area fatigue, as well as reduced fatigue upon exposure to room light. See also U.S. Pat. Nos. 4,973,536; 3,816,118; 5,364,727; 5,204,200; 4,975,350; and 5,053,303, all of which are discussed above, regarding the use of polyvinyl chloride and/or polycarbonates in photoconductors. However, none of these patents-disclose the specific combination of X-form metal-free phthalocyanine and medium molecular weight polyvinyl chloride binder in the charge generating layer, and polyestercarbonate binder in the charge transport layer which are required to achieve the benefits of the present invention.

SUMMARY OF THE INVENTION

The present invention relates to a photoconductive member which has a charge generation layer comprising from about 10 to about 50 parts of a phthalocyanine material (preferably X-form metal-free phthalocyanine) and from about 50 to about 90 parts of a medium molecular weight polyvinyl chloride binder, the phthalocyanine being finely ground in a dispersion in said polyvinyl chloride, together with a charge transfer layer comprising a polyestercarbonate binder. Specifically, the present invention relates to a photoconductive member comprising:

(a) a ground plane member;

(b) a charge generating layer carried by said ground plane member comprising from about 10 to about 50 parts phthalocyanine and from about 50 to about 90 parts polyvinyl chloride binder having a molecular weight of from about 25,000 to about 300,000, the phthalocyanine being present as fine particles in a dispersion in said polyvinyl chloride; and (c) a charge transport layer carried by said charge generating layer comprising from about 30 to about 70 parts of a charge transport molecule and from about 30 to about 70 parts of a polyestercarbonate binder having a molecular weight from about 40,000 to about 100,000.

As used herein, all percentages, ratios and parts are "by weight" unless otherwise specified.

DETAILED DESCRIPTION OF THE INVENTION

Photoconductors of the present invention find utility in electrophotographic reproduction devices, such as copiers and printers, and may be generally characterized as layered photoconductors wherein one layer (the charge generating layer) absorbs light and, as a result thereof, generates electrical charge carriers, while the second overlying layer (the charge transport layer) transports those charge carriers to the exposed surface of the photoconductor.

In the photoconductor structure, a substrate, which may be flexible (such as a flexible web or a belt) or inflexible (such as a drum), is uniformly coated with a thin layer of metallic aluminum. The aluminum layer functions as an electrical ground plane. In a preferred embodiment, the aluminum is anodized, which turns the aluminum surface into a thicker aluminum oxide surface (having a thickness of from about 2 to about 12 microns, preferably from about 4 to about 7 microns). The ground plane member may be a metallic plate, such as aluminum or nickel, a metallic drum or foil, a plastic film on which is vacuum evaporated aluminum, tin oxide, or indium oxide, for example, or a conductive substance-coated paper or plastic film or drum.

The aluminum layer is then coated with a thin, uniform thickness charge generating layer comprising a polyvinyl chloride binder and a phthalocyanine photosensitive molecule. Finally, a uniform thickness charge transport layer is coated onto the charge generating layer. The charge transport layer comprises a polyestercarbonate binder containing a charge transport molecule.

The thickness of the various layers in the structure is not critical and is well known to those skilled in the art. In an exemplary photoconductor, the ground plane layer has a thickness of from about 0.01 to about 0.07 microns, the charge generating layer has a thickness of from about 0.05 to about 5.0 microns, preferably from about 0.1 to about 2.0 microns, most preferably from about 0.1 to about 0.5 micron, and the charge transport layer is from about 10 to about 25 microns, preferably from about 20 to about 25 microns thick. If a barrier layer is used between the ground plane and the charge generating layer, it has a thickness of from about 0.05 to about 2.0 microns.

In forming the charge generating layer utilized in the present invention, a fine dispersion of a small particle phthalocyanine dye is formed in a medium molecular weight polyvinyl chloride binder, and this dispersion is coated onto the ground plane layer. This is generally done by preparing a dispersion containing the phthalocyanine, the binder and a solvent, coating the dispersion onto the ground plane member, and drying the coating.

The dyes which may be utilized in the present invention are phthalocyanine dyes which are well known to those skilled in the art. Examples of such materials are taught in U.S. Pat. No. 3,816,118, Byrne, issued Jun. 11, 1974, incorporated herein by reference. Any suitable phthalocyanine may be used to prepare the charge generating layer used in the present invention. The phthalocyanine used may be in any suitable crystal form. It may be unsubstituted or substituted either (or both) in the ring and straight chain portions. Useful materials are described, and their synthesis given, in Moser and Thomas, *Phthalocyanine Compounds,* Reinhold Publishing Company, 1963, incorporated herein by reference. Preferred phthalocyanine materials are those in which the metal central in the structure is titanium (i.e., titanyl phthalocyanines) and the metal-free phthalocyanines. The metal-free phthalocyanines are particularly preferred, especially the X-crystalline form metal-free phthalocyanines. Such materials are disclosed in U.S. Pat. No. 3,357,989, Byrne, et al., issued Dec. 12, 1967; U.S. Pat. No. 3,816,118, Byrne, issued Jun. 11, 1974, and U.S. Pat. No. 5,204,200, Kobata, et al., issued Apr. 20, 1993, all of which are incorporated herein by reference. The X-type non-metal phthalocyanine is represented by the formula:

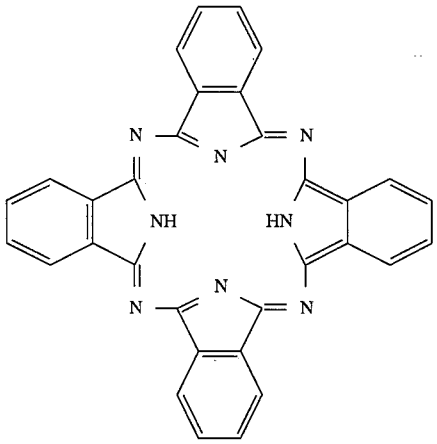

Such materials are available in an electrophotographic grade of very high purity, for example, under the trade name Progen-XPC from Zeneca Company.

The polyvinyl chloride (PVC) compound utilized as a binder in forming the charge generating layer is a medium molecular weight material, having an average molecular weight (weight average) of from about 25,000 to about 300,000, preferably from about 50,000 to about 125,000, most preferably about 80,000. The material may contain a variety of substituents including chlorine, oxirane, acrylonitrile or butyral, although the preferred material is unsubstituted. Polyvinyl chloride materials useful in the present invention are well-known to those skilled in the art. Examples of such material are commercially available as GEON 110X426 from the Geon Company. Similar polyvinyl chlorides are available from the Union Carbide Corp.

A mixture of the phthalocyanine dye is formed in the polyvinyl chloride. This mixture generally Contains from about 10 parts to about 50 parts, preferably from about 10 parts to about 30 parts, most preferably about 20 parts of the phthalocyanine component and from about 50 parts to about 90 parts, preferably from about 70 parts to about 90 parts, most preferably about 80 parts of the polyvinyl chloride component. Polyvinyl chloride copolymers, such as vinyl chloride-vinyl acetate-maleic anhydride copolymers, which are well known as binders in the art, are not useful in the present invention as the sole binder in the charge generating layer, although such copolymers as well as any other conventionally known binders may be used together with the polyvinyl chloride as cobinders in the present invention. If a cobinder is used, at least about 75% of the total binder mixture should be polyvinyl chloride.

The phthalocyanine/polyvinyl chloride mixture is then mixed with a solvent or dispersing medium for further processing. The solvent selected should: (1) be a true solvent for high molecular weight polymers, (2) be non-reactive with all components, and (3) have low toxicity. Examples of dispersing media/solvents which may be utilized in the present invention, used either alone or in combination with preferred solvents, include hydrocarbons, such as hexane, benzene, toluene and xylene; halogenated hydrocarbons, such as methylene chloride, methylene bromide, 1,2-dichloroethane, 1,1,2-trichloroethane, 1,1,1-trichloroethane, 1,2-dichloropropane, chloroform, bromoform, and chlorobenzene; ketones, such as acetone, methylethyl ketone and cyclohexanone; esters, such as ethyl acetate and butyl acetate; alcohols, such as methanol, ethanol, propanol, butanol, cyclohexanol, heptanol, ethylene glycol, methyl cellosolve, ethyl cellosolve and cellosolve acetate, and derivatives thereof; ethers and acetals, such as tetrahydrofuran, 1,4-dioxane, furan and furfural; amines, such as pyridine, butylamine, diethylamine, ethylenediamine and isopropanol amine; nitrogen compounds including amides, such as N,N-dimethylformamide; fatty acids and phenols; and sulphur and phosphorus compounds, such as carbon disulfide and triethyl phosphate. The preferred solvents for use in the present invention are methylene chloride, cyclohexanone and tetrahydrofuran (THF). The mixtures formed include from about 10% to about 50%, preferably from about 10% to about 30%, most preferably about 20% of the phthalocyanine/PVC mixture and from about 50% to about 90%, preferably from about 70% to about 90%, most preferably about 80% of the solvent/dispersing medium.

The entire mixture is then ground, using a conventional grinding mechanism, until the desired dye particle size is reached and is dispersed in the mixture. The organic pigment (phthalocyanine) may be pulverized into fine particles using, for example, a ball mill, homomixer, sand mill, ultrasonic disperser, attritor or sand grinder. The preferred device is a sand mill grinder. The phthalocyanine dye has a particle size (after grinding) ranging from submicron (e.g., about 0.01 micron) to about 5 microns, with a particle size of from about 0.05 to about 0.5 micron being preferred.

The charge generating layer is then coated onto the ground plane member. The dispersion from which the charge generating layer is formed is coated onto the ground plane layer using methods well known in the art including dip coating, spray coating, blade coating or roll coating, and is then dried. The preferred method for use in the present invention is dip coating. The thickness of the charge generating layer formed should preferably be from about 0.1 to about 2.0 microns, most preferably around 0.5 micron. The thickness of the layer formed will depend upon the consistency of the dispersion into which the ground plane member is dipped as well as the time and temperature of the dip process. Once the ground plane member has been coated with the charge generating layer, it is allowed to cure for from about 10 to about 60 minutes, preferably about 30 minutes, at a temperature of from about 60° C. to about 160° C., preferably about 100° C.

The charge transport layer is then prepared and laid on the ground plane member so as to cover the charge generating layer. The charge transport layer is formed from a solution containing a charge transport molecule in a polyestercarbonate binder, coating this solution onto the charge generating layer and drying the coating.

The polyestercarbonate binders utilized in forming the charge transport layer are known in the art and are described in U.S. Pat. No. 4,330,662, Bales, issued May 18, 1982, and U.S. Pat. No. 5,130,215, Adley, et al., issued Jul. 14, 1992, both of which are incorporated herein by reference. U.S. Pat. No. 4,330,662 describes an ordered co-polyestercarbonate of the type used as a binder herein. The polymeric material described in this patent is said to have superior heat resistance, clarity and impact strength, and is said to be useful for making tough transparent films. As used herein, the term polyestercarbonate is intended to mean the material described in U.S. Pat. Nos. 4,330,662 and 5,130,215. The molecular structure of this material is represented by the formula given below.

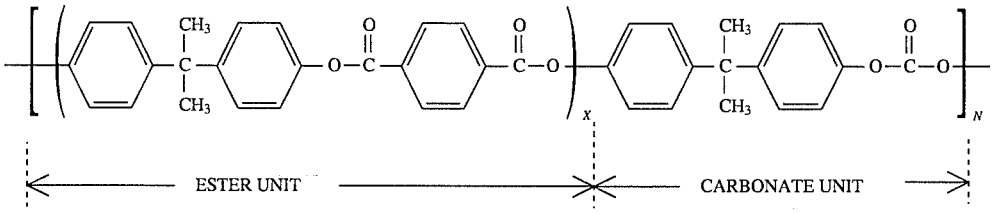

In this formula, the ester content of the polyestercarbonate used in the present invention is from about 35 to about 70 wt. %, and is preferably in the range of from about 60 to about 70 wt. %. Within this range, an ester content of about 70 wt. % is most preferred. These materials are thermoplastic aromatic (i.e., they contain aromatic ester components) polyestercarbonates. They have a molecular weight (weight average) of from about 40,000 to about 100,000, preferably about 60,000. The glass transition temperatures of these materials (which is important to insure appropriate processing) is from about 160° to about 190° C., and is preferably about 170° C. Preferred materials for use in the present invention are commercially available as APEC DP9-9308, from Miles, Inc. It is preferred that no co-binders be included with the polyester carbonates in forming the charge transport layer.

The charge transport molecules utilized in the present invention are well known in the art. A fundamental requirement of those low molecule weight organic compounds is that mobility (positive hole transfer through the layer) must be such that charge can transit the layer in a time that is short compared to the time between exposure and image development. Hole transport occurs through the transfer of charge from states associated with the donor/acceptor functionalities. This can be described as a one-electron oxidation-reduction or donor-acceptor process. Oxidation potential measurements have been used to evaluate the efficacy of charge transport molecules. Examples of such compounds are disclosed in U.S. Pat. No. 5,053,303, Sakaguchi, et al., issued Oct. 1, 1991, incorporated herein by reference. Preferred charge transport molecules are selected from hydrazones, butadienes, pyrazolines, and mixtures of those compounds. Hydrazones useful in the present invention are those compounds having the following general formula:

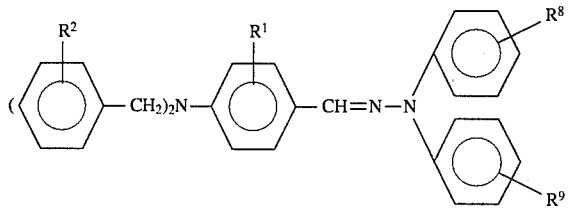

wherein $R^1$, $R^2$, $R^8$ and $R^9$, independently from each other, represent a hydrogen or a lower alkyl.

Butadienes useful in the present invention are those compounds having the following general formula:

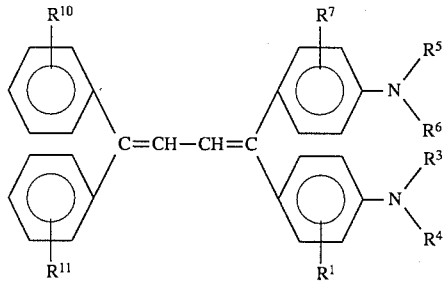

wherein $R^3$ and $R^4$, independently from each other, represent a lower alkyl, and $R^1$, $R^5$, $R^6$, $R^{10}$ and $R^{11}$, independently from each other, represent hydrogen or a lower alkyl.

The pyrazoline compounds useful in the present invention are those having the following structural formula:

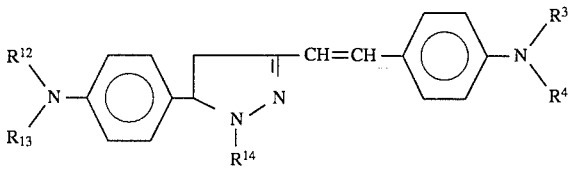

wherein $R^3$, $R^4$, $R^{12}$ and $R^{13}$, independently from each other, represent a lower alkyl, and $R^{14}$ represents a phenol group which may contain one or more substituents.

Hydrazones are the preferred charge transport molecules for use in the present invention, with those of the following structure being most preferred:

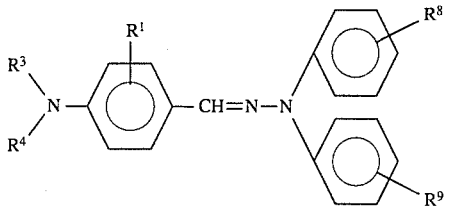

wherein $R^1$, $R^8$ and $R^9$, independently from each other, represent hydrogen or a lower alkyl, and $R^3$ and $R^4$, independently from each other, represent a lower alkyl.

The most preferred charge transport molecule is known as DEH, having the chemical name p-diethylaminobenzaldehyde-N,N-diphenylhydrazone. This compound has the following structural formula:

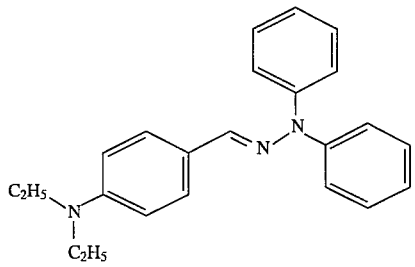

The charge transport layer may also contain certain optional components which are well known in the art, used at their art established levels. Examples of such components include silicone additives to improve the flow of the layer as it coats the photoconductor surface (e.g., low molecular weight polydimethylsiloxane materials), and a room light protector (such as acetysol yellow dye).

The mixture of charge transport molecule and binder, having a composition of from about 30% to about 70%, preferably about 60% of the binder, and from about 30% to about 70%, preferably about 40% of the transport molecule, is then formulated. This mixture is added to a solvent/dispersing medium, such as those discussed above for use in forming the charge generation layer. Preferred solvents are THF, cyclohexanone and methylene chloride. It is preferred that the solution contain from about 10% to about 40%, preferably about 25% of the binder/transport molecule mixture and from about 60% to about 90%, preferably about 75% of the solvent. The charge transport layer is then coated onto the charge generating layer the ground plane member using any of the conventional coating techniques discussed above. Dip coating is preferred. The thickness of the charge transport layer is generally from about 10 to about 25 microns, preferably from about 20 to about 25 microns. The percentage solids in the solution, the temperature of the solution, and the withdrawal speed control the thickness of the transport layer.

In addition to the layers discussed above, an undercoat layer may be placed between the ground plane member (substrate) and the charge generating layer. This is essentially a primer layer which covers over any imperfections in the substrate layer and improves the uniformity of the thin charge generation layer formed. Materials which may be used to form this undercoat layer include epoxy, polyamide and polyurethane. It is also possible to place an overcoat layer (i.e., a surface protecting layer) on top of the charge transport layer. This protects the charge transport layer from wear and abrasion during the printing process. Materials which may be used to form this overcoat layer include polyurethane, phenolic, polyamide and epoxy. These structures are well known to those skilled in the art.

The following example illustrates the photoconductors of the present invention. This example is intended to be illustrative and not limiting of the present invention.

EXAMPLE

A two layer photoconductor drum of the present invention is made in the following manner.

A polyvinyl chloride polymer binder (molecular weight= 80,000, commercially available from the Geon Company) is dissolved in a solvent selected from THF, cyclohexanone, 1,2-dichloromethane, and mixtures of those materials. The solution contains from about 5 to about 25 parts by weight of polyvinyl chloride in the solvent (preferably about 10 to about 20 parts, most preferably about 16 parts). A particulate, ultra-pure, metal-free, x-form phthalocyanine dye (Progen-XPC, commercially available from Zeneca) is mixed with the polyvinyl chloride/solvent solution in a ratio of 20 parts by weight phthalocyanine to 80 parts by weight polyvinyl chloride polymer. The solvent in this mixture makes up about 80 parts by weight of the total mixture. The resultant mixture is then ground for about 2 hours in a sand mill disperser. Suitable types of mills are commercially available from Morehouse Industries, Draiswerke GmbH, Premier Mill Corp. and Netzsch, Inc. A cooling water jacket around the dispersion chamber is required to maintain the temperature of the dispersion mixture below 30° C. The grinding media is most effective in this application if the bead size is between about 0.7 and 1.2 mm in diameter. The resulting phthalocyanine particles have a particle size of about 0.05 microns.

An aluminum drum, which is anodized such that it has an aluminum oxide layer on the surface (thickness about 6 microns), is then dip coated by inserting the drum into the phthalocyanine/PVC/THF mixture at a temperature of about 20° C. The drum is then withdrawn from the mixture at a speed commensurate with the desired layer thickness. The drum is allowed to cure for 30 minutes at a temperature of 100° C. The charge generation layer formed on the drum is measured by optical densitometry and has a thickness of about 0.5 microns.

The mixture used to make the charge transport layer is then prepared by mixing a polyestercarbonate material (APEC DP9-9308 available from Miles, Inc.), having a molecular weight (weight average) of about 60,000 and a glass transition temperature of about 170° C., with DEH charge transport molecule (commercially available from Eastman Chemical Co.) at a temperature of about 20° C. The mixture contains about 40% by weight DEH, about 58.5% by weight of the polyestercarbonate, a trace amount of a silicone additive to improve flow (Dow Corning-200 centistoke PDMS) and about 1.5% of a room light protector (acetysol yellow dye, commercially available from Sandoz Chemical). This mixture is added to THF (25% solids/75% THF). The coated aluminum core is then dipped into this transport layer mixture at a temperature of about 20° C. The aluminum core is then removed from the mixture at a speed commensurate with the desired layer thickness, and cured for one hour at 100° C. The thickness of the charge transport layer formed is about 20 to about 25 microns.

The photoconductor formed, when compared to conventional photoconductors, exhibits excellent and superior cycling stability and improved oil resistance when used together with a liquid toner.

What is claimed is:

1. A photoconductive member consisting essentially of:

(a) a ground plane member;

(b) a charge generating layer carried by said ground plane member comprising from about 10 to about 50 parts by weight X-form metal-free phthalocyanine and from about 50 to about 90 parts by weight polyvinyl chloride binder having a molecular weight of from about 25,000 to about 300,000, the phthalocyanine being present as fine particles in a dispersion in said polyvinyl chloride; and (c) a charge transport layer carried by said charge generating layer comprising from about 30 to about 70 parts by weight of a charge transport molecule and from about 30 to about 70 parts by weight of a polyestercarbonate having a molecular weight of from about 40,000 to about 100,000.

2. A photoconductive member according to claim 1 wherein the thickness of the charge generating layer is from about 0.1 to about 2.0 microns.

3. A photoconductive member according to claim 2 wherein the thickness of the charge transport layer is from about 10 to about 25 microns.

4. A photoconductive member according to claim 3 wherein the charge transport molecule is selected from the group consisting of butadienes, hydrazones, pyrazolines, and mixtures thereof.

5. A photoconductive member according to claim 4 wherein the polyestercarbonate has the formula:

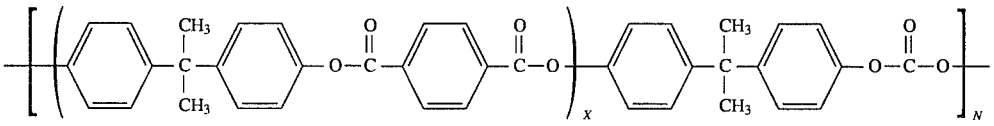

wherein X and N have values such that said polyestercarbonate has an ester content of from about of 35% to about 70% by weight.

6. A photoconductive member according to claim 5 wherein the charge transport molecule is a hydrazone.

7. A photoconductive member according to claim 6 wherein the charge generating layer contains from about 10 to about 30 parts by weight phthalocyanine and from about 70 to about 90 parts by weight polyvinyl chloride.

8. A photoconductive member according to claim 7 wherein the phthalocyanine has a particle size of from about 0.01 to about 0.5 microns.

9. A photoconductive member according to claim 7 wherein the charge transport molecule is DEH.

10. A photoconductive member according to claim 9 wherein the polyvinyl chloride has a molecular weight of from about 50,000 to about 125,000.

11. A photoconductive member according to claim 10 wherein the charge generating layer contains about 20 parts by weight phthalocyanine and about 80 parts by weight polyvinyl chloride and the charge transport layer contains about 60 parts by weight polyestercarbonate and about 40 parts by weight DEH.

12. A photoconductive member having a charge generating layer comprising from about 10 to about 50 parts by weight X-form metal-free phthalocyanine and from about 50 to about 90 parts by weight medium molecular weight polyvinyl chloride binder, the phthalocyanine being finely ground in a dispersion in said polyvinyl chloride, and a charge transfer layer comprising a polyestercarbonate binder.

* * * * *